US010935237B2

(12) United States Patent
Vorlicek et al.

(10) Patent No.: US 10,935,237 B2
(45) Date of Patent: Mar. 2, 2021

(54) LEAKAGE DETECTION IN A FLAME SENSE CIRCUIT

(71) Applicant: Honeywell International Inc., Morris Plains, NJ (US)

(72) Inventors: Jan Vorlicek, Stepanovice (CZ); Jiri Kastan, Brno (CZ); John Evers, Albany, MN (US)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/692,026

(22) Filed: Nov. 22, 2019

(65) Prior Publication Data

US 2020/0208838 A1 Jul. 2, 2020

Related U.S. Application Data

(60) Provisional application No. 62/786,181, filed on Dec. 28, 2018.

(51) Int. Cl.
*F23N 5/12* (2006.01)
*F23N 5/24* (2006.01)

(52) U.S. Cl.
CPC ..... *F23N 5/123* (2013.01); *F23N 5/24* (2013.01); *F23N 2227/00* (2020.01); *F23N 2229/00* (2020.01); *F23N 2231/00* (2020.01); *F23N 2237/00* (2020.01); *F23N 2900/00* (2013.01)

(58) Field of Classification Search
CPC .. F23N 2237/00; F23N 2229/00; F23N 5/123; F23N 5/24; F23N 2900/00; F23N 2231/00; F23N 2227/00
See application file for complete search history.

(56) References Cited

U.S. PATENT DOCUMENTS 2,410,524 A * 11/1946 Richardson ..... F23N 5/123 431/25
2,737,643 A * 3/1956 Marsden, Jr. ..... F23N 5/123 340/579
3,425,780 A 2/1969 Potts
3,520,645 A 7/1970 Cotton et al.
3,589,848 A * 6/1971 Potts ..... F23Q 5/00 431/78
3,627,458 A * 12/1971 Wade ..... F23N 5/123 431/25
3,649,156 A 3/1972 Conner
3,681,001 A 8/1972 Potts
(Continued)

FOREIGN PATENT DOCUMENTS

EP 0967440 A2 12/1999
EP 1148298 B1 10/2004
WO 9718417 A1 5/1997

OTHER PUBLICATIONS

Honeywell, "S4965 SERIES Combined Valve and Boiler Control Systems," 16 pages, prior to Jul. 3, 2007.
(Continued)

*Primary Examiner* — Rufus C Point

(57) ABSTRACT

A flame detection system is designed to detect leakage in flame sense circuits. The flame detection system includes a flame sensor, an amplifier, a detection circuit, and a micro-controller. Flame sense circuitry use operational amplifiers that needs negative voltage supply for its operation. Negative supply voltage properly measures negative input signals. Once a leakage current in the flame detection system is determined a shutdown signal is provided to shut down a flame sensor when the leakage current condition is determined.

20 Claims, 6 Drawing Sheets

(56) References Cited

U.S. PATENT DOCUMENTS 3,836,857 A 9/1974 Ikegami et al.
3,870,929 A * 3/1975 Carlson ..... F23N 5/123 361/256
3,909,816 A 9/1975 Teeters
4,035,134 A 7/1977 Matthews
4,157,506 A 6/1979 Spencer
4,221,557 A 9/1980 Jalics
4,242,079 A 12/1980 Matthews
4,269,589 A 5/1981 Matthews
4,280,184 A 7/1981 Weiner et al.
4,303,385 A 12/1981 Rudich et al.
4,370,557 A 1/1983 Axmark et al.
4,450,499 A 5/1984 Sorelle
4,457,692 A 7/1984 Erdman
4,483,672 A 11/1984 Wallace et al.
4,521,825 A 6/1985 Crawford
4,527,247 A 7/1985 Kaiser et al.
4,555,800 A 11/1985 Nishikawa et al.
4,622,005 A 11/1986 Kuroda
4,626,193 A 12/1986 Gann
4,655,705 A 4/1987 Shute et al.
4,672,324 A 6/1987 van Kampen
4,695,246 A 9/1987 Beilfuss et al.
4,709,155 A 11/1987 Yamaguchi et al.
4,777,607 A 10/1988 Maury et al.
4,830,601 A 5/1989 Dahlander et al.
4,842,510 A 6/1989 Grunden et al.
4,843,084 A 6/1989 Parker et al.
4,872,828 A 10/1989 Mierzwinski et al.
4,904,986 A 2/1990 Pinckaers
4,925,386 A * 5/1990 Donnelly ..... F23N 5/203 431/28
4,949,355 A 8/1990 Dyke et al.
4,955,806 A 9/1990 Grunden et al.
5,026,270 A 6/1991 Adams et al.
5,026,272 A 6/1991 Takahashi et al.
5,037,291 A 8/1991 Clark
5,073,769 A 12/1991 Kompelien
5,077,550 A 12/1991 Cormier
5,112,117 A 5/1992 Altmann et al.
5,126,721 A 6/1992 Butcher et al.
5,158,477 A 10/1992 Testa et al.
5,175,439 A 12/1992 Haerer et al.
5,222,888 A 6/1993 Jones et al.
5,236,328 A 8/1993 Tate et al.
5,255,179 A 10/1993 Zekan et al.
5,276,630 A 1/1994 Baldwin et al.
5,280,802 A 1/1994 Comuzie, Jr.
5,300,836 A 4/1994 Cha
5,347,982 A 9/1994 Binzer et al.
5,365,223 A * 11/1994 Sigafus ..... F23N 5/082 340/578
5,391,074 A 2/1995 Meeker
5,424,554 A 6/1995 Marran et al.
5,446,677 A 8/1995 Jensen et al.
5,472,336 A 12/1995 Adams et al.
5,506,569 A 4/1996 Rowlette
5,548,277 A * 8/1996 Wild ..... F23N 5/082 340/578
5,567,143 A 10/1996 Servidio
5,599,180 A 2/1997 Peters et al.
5,682,329 A 10/1997 Seem et al.
5,722,823 A 3/1998 Hodgkiss
5,797,358 A 8/1998 Brandt et al.
5,971,745 A 10/1999 Bassett et al.
6,013,919 A 1/2000 Schneider et al.
6,060,719 A 5/2000 DiTucci et al.
6,071,114 A 6/2000 Cusack et al.
6,084,518 A * 7/2000 Jamieson ..... F23N 5/123 340/577
6,222,719 B1 4/2001 Kadah
6,261,086 B1 7/2001 Fu
6,299,433 B1 10/2001 Gauba et al.
6,346,712 B1 2/2002 Popovic et al.
6,349,156 B1 2/2002 O'Brien et al.
6,356,827 B1 3/2002 Davis et al.
6,385,510 B1 5/2002 Hoog et al.
6,457,692 B1 10/2002 Gohl
6,474,979 B1 11/2002 Rippelmeyer
6,486,486 B1 11/2002 Haupenthal
6,509,838 B1 1/2003 Payne et al.
6,552,865 B2 4/2003 Cyrusian
6,676,404 B2 1/2004 Lochschmied
6,743,010 B2 6/2004 Bridgeman et al.
6,782,345 B1 8/2004 Siegel et al.
6,794,771 B2 9/2004 Orloff
6,912,671 B2 6/2005 Christensen et al.
6,917,888 B2 7/2005 Logvinov et al.
6,923,640 B2 8/2005 Canon
7,088,137 B2 8/2006 Behrendt et al.
7,088,253 B2 8/2006 Grow
7,202,794 B2 4/2007 Huseynov et al.
7,241,135 B2 7/2007 Munsterhuis et al.
7,255,284 B2 8/2007 Kim et al.
7,255,285 B2 8/2007 Troost et al.
7,274,973 B2 9/2007 Nichols et al.
7,289,032 B2 10/2007 Seguin et al.
7,327,269 B2 2/2008 Kiarostami
7,460,966 B1 * 12/2008 Hattori
7,617,691 B2 11/2009 Street et al.
7,728,736 B2 6/2010 Leeland et al.
7,764,182 B2 7/2010 Chian et al.
7,768,410 B2 8/2010 Chian
7,800,508 B2 9/2010 Chian et al.
7,806,682 B2 10/2010 Cueva
8,066,508 B2 11/2011 Nordberg et al.
8,085,521 B2 12/2011 Chian
8,300,381 B2 10/2012 Chian et al.
8,310,801 B2 11/2012 McDonald et al.
8,659,437 B2 2/2014 Chian
8,875,557 B2 11/2014 Chian et al.
9,784,449 B2 10/2017 Margolin
10,151,492 B2 12/2018 Huang et al.
10,215,809 B2 2/2019 Mills et al.
10,473,329 B2 * 11/2019 Vorlicek ..... F23N 5/123
2002/0099474 A1 7/2002 Khesin
2003/0222982 A1 12/2003 Hamdan et al.
2004/0209209 A1 10/2004 Chodacki et al.
2005/0086341 A1 4/2005 Enga et al.
2005/0092851 A1 5/2005 Troost et al.
2006/0257801 A1 * 11/2006 Chian ..... F23N 5/123 431/18
2006/0257802 A1 * 11/2006 Chian ..... F23N 5/123 431/18
2006/0257804 A1 11/2006 Chian et al.
2006/0257805 A1 11/2006 Nordberg et al.
2007/0159978 A1 7/2007 Anglin et al.
2007/0188971 A1 8/2007 Chian et al.
2007/0207422 A1 9/2007 Cueva
2008/0266120 A1 10/2008 Leeland et al.
2009/0009344 A1 1/2009 Chian
2009/0136883 A1 5/2009 Chian et al.
2010/0013644 A1 1/2010 McDonald et al.
2010/0265075 A1 10/2010 Chian
2012/0288806 A1 * 11/2012 Racaj ..... F23N 5/123 431/18
2016/0091204 A1 3/2016 Patton et al.
2016/0091205 A1 3/2016 Solosky et al.
2016/0091903 A1 3/2016 Patton et al.
2016/0092388 A1 3/2016 Sorenson et al.
2016/0098055 A1 4/2016 Solosky et al.
2016/0123624 A1 5/2016 Solosky
2019/0195493 A1 * 6/2019 Vorlicek ..... F23N 5/242
2020/0208838 A1 * 7/2020 Vorlicek ..... F23N 5/123

OTHER PUBLICATIONS

Honeywell, "SV9410/SV9420; SV9510/SV9520; SV9610/SV9620 SmartValve System Controls," Installation Instructions, 16 pages, 2003.

(56) References Cited

OTHER PUBLICATIONS www.playhookey.com, "Series LC Circuits," 5 pages, printed Jun. 15, 2007.

* cited by examiner

LEAKAGE DETECTION IN A FLAME SENSE CIRCUIT

This application claims the benefit of the filing date of U.S. Provisional Patent Application No. 62/786,181, filed Dec. 28, 2018, the disclosure of which is hereby incorporated by reference.

TECHNICAL FIELD

The present disclosure pertains generally to flame sensing circuits and more particularly to leakage detection for flame sensing circuits.

BACKGROUND

Flame sensing systems are widely used to detect flames in combustion systems, often using flame-sensing rods or the like. In many instances, when no flame is detected, the fuel to the combustion system is turned off to help prevent un-burned fuel from being released in the combustion system. In many instances, flame sensing systems rely on the detection of flame sense signals produced by a flame-sensing rod or the like that is exposed to the flame. The flame sense signals can be small and in some cases rivaled by parasitic leakage currents. When this occurs, there is a danger that the parasitic leakage currents may be misinterpreted as a flame sense signal, which may result in the flame sensing system falsely reporting a flame when no flame is actually present. What would be desirable is an improved flame sensing system that can reliably detect such leakage currents to help improve the accuracy and reliability of a flame sensing system.

SUMMARY

The disclosure pertains to flame sensing circuits and more particularly to leakage detection for flame sensing circuits. A particular example of the disclosure is found in a flame detection system that includes a flame sensor for sensing a flame, where the flame sensor may draw a flame sense current when a flame is present. An amplifier may be operatively coupled to the flame sensor for amplifying the flame sense current and for drawing an amplified flame sense current from an amplifier output. A detection circuit may be operatively coupled to the amplifier output for detecting the amplified flame sense current.

The detection circuit may include a capacitor having a first end operatively coupled to the amplifier output and a first resistor having a first end operatively coupled to the amplifier output. The first resistor may have a first resistance value. A second resistor may have a first end operatively coupled to the amplifier output and the second resistor may have a second resistance value that is different from the first resistance value.

A microcontroller may be operatively coupled to a second end of the first resistor and a second end of the second resistor and the first end of the capacitor. The microcontroller may be configured to charge the capacitor through the first resistor from a first lower threshold voltage to a first upper threshold voltage, and then allow the amplified flame sense current to discharge the capacitor down to the first lower threshold voltage. The microcontroller may determine a first duty cycle for charging and discharging of the capacitor through the first resistor. The microcontroller may also charge the capacitor through the second resistor from a second lower threshold voltage to a second upper threshold voltage. Then the microcontroller may allow the amplified flame sense current to discharge the capacitor down to the second lower threshold voltage. Further, the microcontroller may determine a second duty cycle of the charging and discharging of the capacitor through the second resistor. The microcontroller may determine a leakage current condition in the flame detection system based at least in part on the first duty cycle, the second duty cycle, the first resistance value and the second resistance value. The microcontroller may also provide a shutdown signal to shut down the flame (e.g. close a gas valve that supplies fuel to the combustion system) when the leakage current condition is determined.

Another example of the disclosure is method for detecting a leakage current condition in a flame detection system. The method may include amplifying with an amplifier a flame sense current provided by a flame sensor, resulting in an amplified flame sense current. The method may supply the amplified flame sense current to the amplifier via charge storage device and charge the charge storage device with a first charging circuit that produces a first charging rate. The method further may include subsequently charging the charge storage device with a second charging circuit that produces a second charging rate, wherein the second charging rate may be different from the first charging rate. The method may determine a leakage current condition in the flame detection system based at least in part on a comparison of the charging of the charge storage device with the first charging circuit and the charging of the charge storage device with the second charging circuit. The microcontroller may also provide a shutdown signal to shut down the flame (e.g. close a gas valve that supplies fuel to the combustion system) when the leakage current condition is determined.

Another example of the disclosure is a flame detection system that includes a flame sensor for sensing a flame. The flame sensor may draw a flame sense current when a flame is present. An amplifier may be operatively coupled to the flame sensor for amplifying the flame sense current and drawing an amplified flame sense current from an amplifier output. A negative voltage supply generator may supply a negative supply voltage to the amplifier. A detection circuit may be operatively coupled to the amplifier output for detecting the amplified flame sense current. A microcontroller may be operatively coupled to the negative voltage supply generator and the detection circuit. The microcontroller may be configured to change the negative supply voltage from a nominal negative supply voltage to a boosted negative supply voltage. The microcontroller may also determine a leakage current condition in the flame detection system when the amplified flame sense current detected by the detection circuit changes by more than a threshold amount when the negative supply voltage is changed from the nominal negative supply voltage to the boosted negative supply voltage and provide a shutdown signal to shut down the flame when the leakage current condition is determined.

BRIEF DESCRIPTION OF DRAWINGS

The disclosure may be more completely understood in consideration of the following description of various illustrative embodiments of the disclosure in connection with the accompanying drawings, in which.

Figure 1:
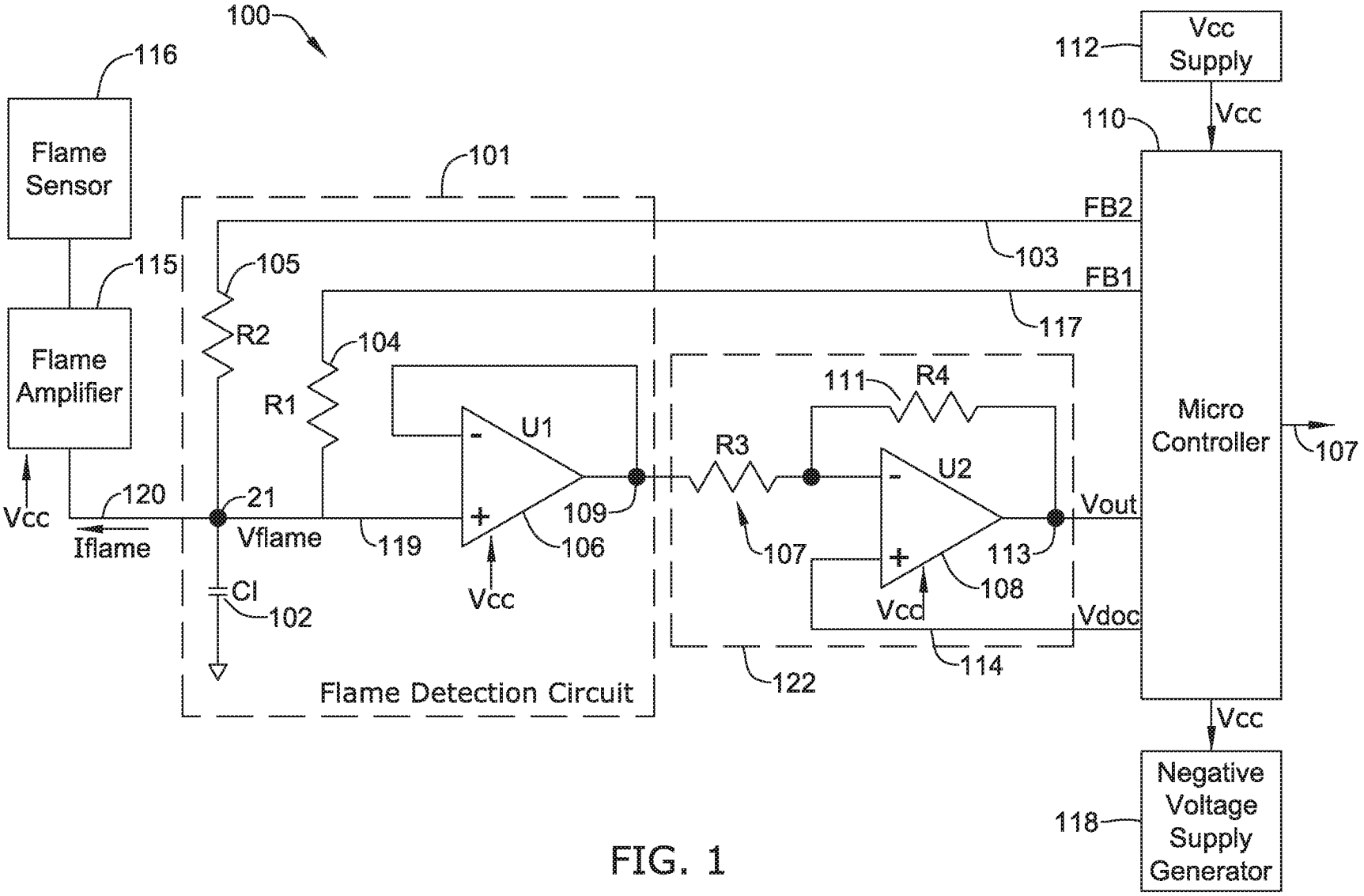
FIG. 1 is a schematic diagram of an illustrative flame detection system that includes a flame detection circuit with circuitry for detecting current leakage.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements. The drawings, which are not necessarily to scale, are not intended to limit the scope of the disclosure. In some of the Figures, elements not believed necessary to an understanding of relationships among illustrated components may have been omitted for clarity.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic may be applied to other embodiments whether or not explicitly described unless clearly stated to the contrary.

The present system and approach may incorporate one or more processors, computers, controllers, user interfaces, wireless and/or wire connections, and/or the like, in an implementation described and/or shown herein. This description may provide one or more illustrative and specific examples or ways of implementing the present system and approach. There may be numerous other examples or ways of implementing the system and approach.

Referring to FIG. 1, which is a schematic diagram of an illustrative flame detection system 100 that includes a flame detection circuit with circuitry for detecting current leakage. The illustrative flame detection system 100 includes a flame sensor 116, a flame amplifier 115, a flame detection circuit 101, an inverting amplifier 122 and a microcontroller 110. The flame sensor 116 may sense a presence of a flame and may draw a flame sense current when a flame is present. In some cases, the flame sensor 116 may include a flame rod. The flame sensor 116 may be positioned adjacent or in a flame. The flame amplifier 115 may be operatively coupled to the flame sensor 116 and may amplify the flame sense current, and may draw an amplified flame sense current $I_{flame}$ from an amplifier output 120.

The flame detection circuit 101 may be operatively coupled to the flame amplifier 115 output 120 for detecting the amplified flame sense current $I_{flame}$. In the example shown, the flame detection circuit 101 may include a capacitor 102 having a first end operatively coupled to the amplifier output 120 at node 21. The capacitor 102 may have any suitable capacitance value. In the example shown, the capacitor 102 has a value of 100 nF and is discharged by $I_{flame}$ being pulled into amplifier output 120 (a negative amplified flame current). A voltage at the capacitor 102 shown as $V_{flame}$ on node 21 may be controlled to stay within a defined voltage range such as −50 mV to 50 mV, although this is just an example. The flame detection circuit 101 may also include a first resistor 104 (R1) that is operatively connected between node 21 and a first pin (FB1) of the microcontroller 110. The first resistor 104 may have a first resistance value such as 82.5 kohms, for example. The flame detection circuit 101 may also include a second resistor 105 (R2) that is operatively connected between node 21 and a second pin (FB2) of the microcontroller 110. The second resistor 105 may have a second resistance value, such as 120 kohms. The first resistor 104, the second resistor 105, the capacitor 102 and the voltage follower amplifier 106 may be considered as collectively forming flame detection circuit 101. The voltage follower amplifier 106 may amplify the $V_{flame}$ signal on node 21 and provide an amplified $V_{flame}$ signal to an inverting amplifier 122, which may further amplify the amplified $V_{flame}$ before being provided to an input pin of the microcontroller 110. The input put of the microcontroller may be connected to an A/D converter to convert the analog flame sense signal to a digital flame sense signal suitable for processing by the microcontroller 110. In the example shown, the microcontroller 110 may provide a baseline value to the "+" input of the operational amplifier 108 of the inverting amplifier 122 as shown. The baseline value may provide a zero point on which to compare and amplify the amplified $V_{flame}$ signal provided by the flame detection circuit 101. In some cases, the baseline value may be ground, but it is contemplated that the baseline value may be any suitable value.

During operation, the microcontroller 110 may be configured to periodically assert the FB1 pin 117 to VCC 112 and switch FB2 pin 103 to a tri-state (e.g. floating) in order to charge the capacitor 102 through the first resistor 104 from a first lower threshold voltage (e.g. −50 mv) to a first upper threshold voltage (e.g. +50 mv), and then allow the amplified flame sense current $I_{flame}$, to discharge the capacitor 102 back down to the first lower threshold voltage (e.g. −50 mv). The microcontroller 110 may determine a first duty cycle D1 of the charging of the capacitor 102 through the first resistor 104 and subsequent discharging of the capacitor 102.

The microcontroller 110 may also periodically assert the FB2 pin 103 to VCC 112 and switch FB1 pin 117 to a tri-state in order charge the capacitor 102 through the second resistor 105 from a second lower threshold voltage (e.g. −50 mv) to a second upper threshold voltage (+50 mv) and then allow the amplified flame sense current $I_{flame}$ to discharge the capacitor 102 back down to the second lower threshold voltage (−50 mv). The microcontroller may determine a second duty cycle D2 of the charging of the capacitor 102 through the second resistor 105 and subsequent discharge of the capacitor 102. In some cases, the first lower threshold voltage may be the same as the second lower threshold voltage, and the a first upper threshold voltage may the same as the a second upper threshold voltage, but this is not required.

The microcontroller 110 may be configured to determine a leakage current condition in the flame detection system 100 based at least in part on the first duty cycle D1, the second duty cycle D2, the first resistance value R1 and the second resistance value R2, as further described below. The microcontroller 110 may provide a shutdown signal to shut down the flame (e.g. close a gas valve supplying fuel to the combustion system) when the leakage current condition is determined.

More specifically, the microcontroller 110 may be configured to determine the first duty cycle D1 by asserting the FB1 pin 117 to VCC 112 and switch FB2 pin 103 to a tri-state (e.g. floating), and then monitoring a voltage at node 21 at the first end of the capacitor 102 and clocking how long it takes to charge the capacitor 102 through the first resistor 104 from the first lower threshold voltage (i.e. −50 mV) to the first upper threshold voltage (ChargeR1Time). The microcontroller 110 may then switch the FB1 pin 117 and the FB2 pin 103 to a tri-state (e.g. floating), and clock how long it takes for the amplified flame sense current $I_{flame}$ to discharge the capacitor 102 back down to the first lower threshold voltage (DischargeFCTime). DischargeFCTime may denote the flame current $I_{flame}$ discharge time. The first duty cycle D1 may be calculated by using the relation ChargeR1Time/(ChargeR1Time+DischargeFCTime). The ChargeR1Time and DischargeFCTime may be averaged values taken over a plurality of charging and discharging cycles of the capacitor 102 to help reduce noise in the system.

The microcontroller 110 may also be configured to determine the second duty cycle D2 by asserting the FB2 pin 103 to VCC 112 and switch FB1 pin 112 to a tri-state (e.g. floating), and then monitoring a voltage at node 21 at the first end of the capacitor 102 and clocking how long it takes to charge the capacitor 102 through the second resistor 105 from the second lower threshold voltage (i.e. −50 mV) to the second upper threshold voltage (ChargeR2Time). The microcontroller 110 may then switch the FB2 pin 103 and the FB1 pin 117 to a tri-state (e.g. floating), and clock how long it takes for the amplified flame sense current $I_{flame}$ to discharge the capacitor 102 back down to the second lower threshold voltage (DischargeFCTime). DischargeFCTime may denote the flame current $I_{flame}$ discharge time. The second duty cycle D2 may be calculated by using the relation ChargeR2Time/(ChargeR2Time+DischargeFCTime). The ChargeR2Time and DischargeFCTime may be averaged values taken over a plurality of charging and discharging cycles of the capacitor 102 to help reduce noise in the system.

When the first lower threshold voltage is the same as the second lower threshold voltage, and the first upper threshold voltage is same as the a second upper threshold voltage, the DischargeFCTime should be the same absent current leakage. Said another way, the ratio D1/D2 should be the same as the ratio R1/R2 absent current leakage. As such, a current leakage condition may be indicated when the ratio D1/D2 deviates from the ratio R1/R2 by more than a threshold amount.

In some cases, a single charge/discharge cycle may be executed using R1 to determine D1, followed by a single charge/discharge cycle using R2 to determine D2. This may be repeated over time. In some cases, the past "N" D1 values may be averaged to determine an average D1 value, where "N" is a positive integer. Likewise, the past "N" D2 values may be averaged to determine an average D2 value. In some cases, two or more consecutive charge/discharge cycles may be executed using R1 to determine D1, followed by two or more consecutive charge/discharge cycles using R2 to determine D2.

In some cases, the microcontroller 110 may be configured to determine the first duty cycle D1 by asserting the FB1 pin 117 to VCC 112 and switch FB2 pin 103 to a tri-state (e.g. floating), and then monitoring a voltage at node 21 at the first end of the capacitor 102 and clocking how long it takes to charge the capacitor 102 through the first resistor 104 from the first lower threshold voltage (i.e. −50 mV) to the first upper threshold voltage (ChargeR1Time). The microcontroller 110 may then switch the FB1 pin 117 and the FB2 pin 103 to a tri-state (e.g. floating), and clock how long it takes for the amplified flame sense current $I_{flame}$ to discharge the capacitor 102 back down to the first lower threshold voltage (DischargeFCTime). The microcontroller 110 may determine the second duty cycle D2 by asserting the FB2 pin 103 to VCC 112 and the FB1 pin 112 to VCC 112, and then monitoring a voltage at node 21 at the first end of the capacitor 102 and clocking how long it takes to charge the capacitor 102 through the first resistor 104 and the second resistor 105 from the second lower threshold voltage (i.e. −50 mV) to the second upper threshold voltage (ChargeR1R2Time). The microcontroller 110 may then switch the FB2 pin 103 and the FB1 pin 117 to a tri-state (e.g. floating), and clock how long it takes for the amplified flame sense current $I_{flame}$ to discharge the capacitor 102 back down to the second lower threshold voltage (DischargeFCTime). In this example, R1 is used to determine the first duty cycle, while the parallel resistance of R1 and R2 is used to determine the second duty cycle.

In some cases, a negative voltage supply generator 118 may supply a negative supply voltage (Vee). This may be useful because the flame sensor 116 may draw a negative current, which produce a negative voltage. The negative supply voltage (Vee) may be provided to the flame amplifier 115, and in some cases the amplifier 106, the amplifier 108 and/or the microcontroller 110. In some cases, the microcontroller 110 may be configured to periodically change the negative supply voltage provided by the negative voltage supply generator 118 from a nominal negative supply voltage (e.g. −800 mv) to a boosted negative supply voltage (−2200 mv), and then back again. If there is no leakage in the flame sensing circuit, the detected flame current $I_{flame}$ should remain the same regardless of whether the negative supply voltage is set to the nominal negative supply voltage (e.g. −800 mv) or the boosted negative supply voltage (−2200 mv). The microcontroller 110 may determine a leakage current condition when the amplified flame sense current $I_{flame}$ detected by the detection circuit changes by more than a threshold amount when the negative supply voltage is changed from the nominal negative supply voltage to the boosted negative supply voltage.

In some cases, the microcontroller 110 may be configured to change the negative supply voltage from the nominal negative supply voltage to the boosted negative supply voltage for a period of time (e.g. 200 milliseconds, 300 milliseconds, 500 milliseconds, 1 second, 5 seconds or any other suitable time) before changing the negative supply voltage back from the boosted negative supply voltage to the nominal negative supply voltage. The microcontroller 110 may wait for a period of time (e.g. 1 second, 2 seconds, 5 seconds, 10 seconds, 60 seconds, or any other suitable time) before again changing the negative supply voltage from the nominal negative supply voltage to the boosted negative supply voltage before changing the negative supply voltage back from the boosted negative supply voltage to the nominal negative supply voltage.

In some cases, and as shown in FIG. 1, the $V_{flame}$ voltage on node 21 may be interfaced to the microcontroller 110 by means of an operational amplifier 106 connected in a voltage follower configuration followed by an operational amplifier 108 connected in an inverting amplifier configuration 122. The gain of the inverting amplifier 122 may be defined by the ratio of resistors R4 and R3. In the example shown, the inverting amplifier 122 may receive a DC bias voltage from the microcontroller 110 on the line 114. The DC bias voltage can be used to translate the output of the flame detection circuit 101, that may track between negative and positive voltages, to an output signal $V_{out}$ that is positive only and suitable for reading by an analog-to-digital converter (ADC) of the microcontroller 110. In some cases, the DC bias voltage on the line 114 is defined by '$V_{dac}$', i.e., a microcontroller DAC output. Rather than providing a DC bias voltage from the microcontroller 110 on the line 114, it contemplated that a suitable voltage may be supplied by, for example, a simple voltage divider.

During use, the microcontroller 110 may track the output signal $V_{out}$ 113 provided by the inverting amplifier 122 and compare the output signal $V_{out}$ 113 to two thresholds that correspond to the $V_{flame}$ thresholds of, for instance, +50 mV and −50 mV at node 21. In some cases, these thresholds correspond to a lower threshold (e.g. the first lower threshold and/or the second lower threshold) and an upper threshold (e.g. the first upper threshold and/or the second upper threshold). The microcontroller 110 may track the output signal $V_{out}$ 113 and control feedback drive pins FB1 and FB2 accordingly, so that node 21 stays within a desired range such as −50 mV to +50 mV as described herein.

Figure 2:
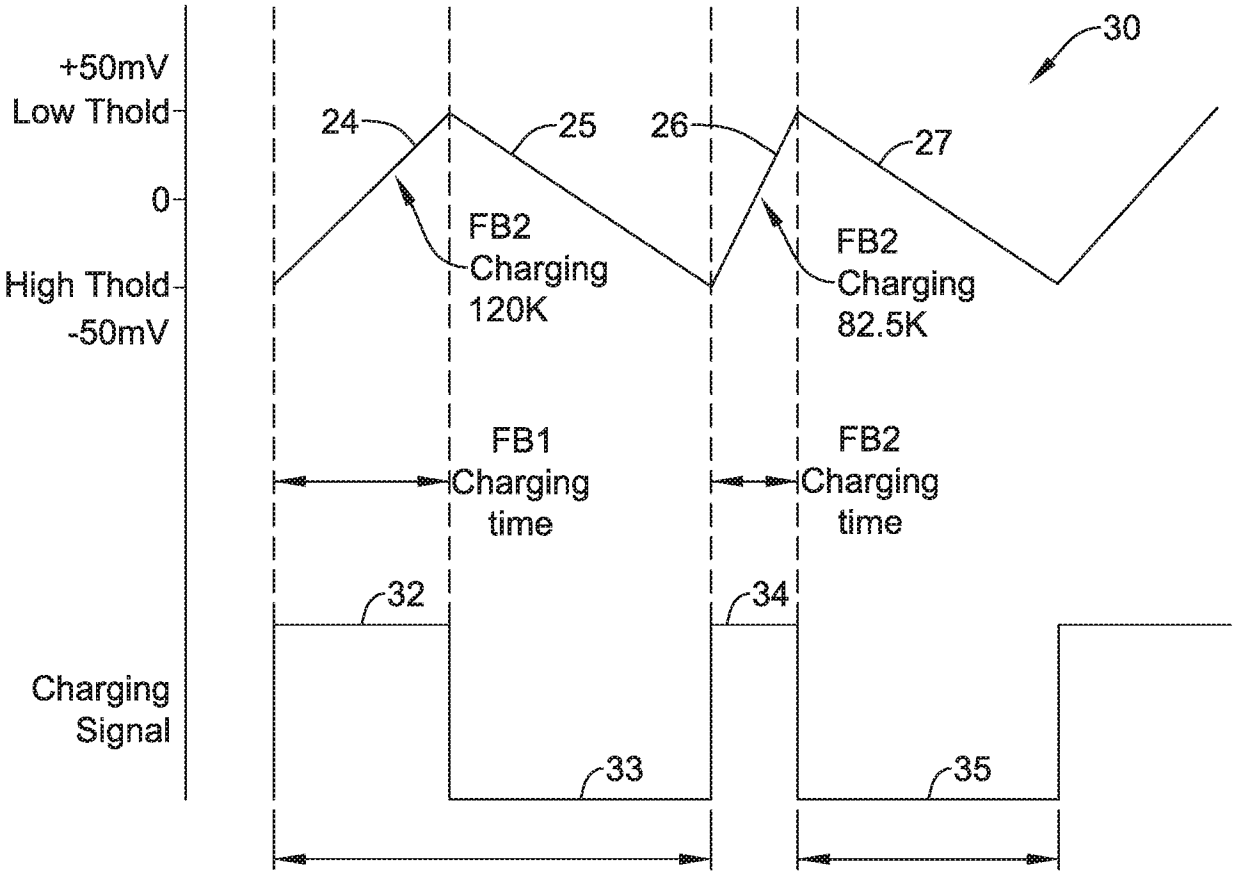
FIG. 2 is a timing diagram showing operation of the circuitry for detecting leakage in the flame sense circuit of FIG. 1.
Figure 3:
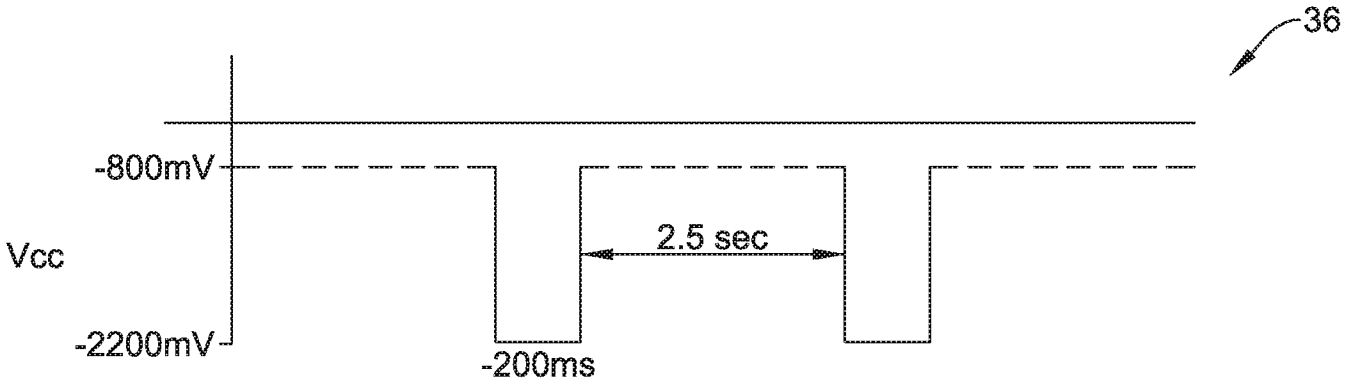
FIG. 3 is a schematic diagram of a pulsed negative supply voltage useful for detecting leakage in a flame sense circuit such as the flame sense circuit of FIG. 1.

FIG. 2 is a timing diagram showing operation of the circuitry for detecting leakage in the flame sense circuit of FIG. 1. The voltage $V_{flame}$ on node 21 of FIG. 1 is illustrated at trace 30. In this example, the voltage $V_{flame}$ on node 21 is controlled to stay within a defined voltage range such as −50 mV to 50 mV. A +/−50 mV ripple is considered as a small working voltage, which can be advantageous to help reduce the impact of leakage currents on the flame sensing measurement, since a parasitic resistance from $V_{flame}$ to ground (or Vee) may result in a parasitic current that can mimic or falsely contribute to the flame sense current $I_{flame}$.

The microcontroller 110 may be configured to determine the first duty cycle D1 by asserting the FB1 pin 117 to VCC 112 as shown at 32 and switch FB2 pin 103 to a tri-state (e.g. floating), and then monitoring a voltage $V_{flame}$ at node 21 at the first end of the capacitor 102 and clocking how long (ChargeR1Time) it takes to charge the capacitor 102 through the first resistor 104 from the first lower threshold voltage (i.e. −50 mV) to the first upper threshold voltage (i.e. +50 mV), as shown at 24. The microcontroller 110 may then switch the FB1 pin 117 and the FB2 pin 103 to a tri-state (e.g. floating) as shown at 33, and clock how long (DischargeFCTime) it takes for the amplified flame sense current $I_{flame}$ to discharge the capacitor 102 back down to the first lower threshold voltage (i.e. −50 mV) as shown at 25. DischargeFCTime may denote the flame current $I_{flame}$ discharge time. The ChargeR1Time plus the DischargeFCTime results in a period P1. The first duty cycle D1 may be calculated by using the relation ChargeR1Time/(ChargeR1Time+DischargeFCTime). In some cases, the ChargeR1Time and DischargeFCTime may be averaged values taken over a plurality of charging and discharging cycles of the capacitor 102 to help reduce noise in the system, but this is not required.

The microcontroller 110 may also be configured to determine the second duty cycle D2 by asserting the FB2 pin 103 to VCC 112 as shown at 34 and switch FB1 pin 112 to a tri-state (e.g. floating), and then monitoring the voltage $V_{flame}$ at node 21 at the first end of the capacitor 102 and clocking how long (ChargeR2Time) it takes to charge the capacitor 102 through the second resistor 105 from the second lower threshold voltage (i.e. −50 mV) to the second upper threshold voltage (i.e. +50 mV), as shown at 26. In the example shown, the first lower threshold voltage is the same as the second lower threshold voltage (i.e. −50 mV), and the first upper threshold voltage is same as the a second upper threshold voltage (i.e. +50 mV), but this is not required. The microcontroller 110 may then switch the FB2 pin 103 and the FB1 pin 117 to a tri-state (e.g. floating) as shown at 35, and clock how long (DischargeFCTime) it takes for the amplified flame sense current $I_{flame}$ to discharge the capacitor 102 back down to the second lower threshold voltage (i.e. −50 mV), as shown at 27. The ChargeR2Time plus the DischargeFCTime results in a period P2. The second duty cycle D2 may be calculated by using the relation ChargeR2Time/(ChargeR2Time+DischargeFCTime). In some cases, the ChargeR2Time and DischargeFCTime may be averaged values taken over a plurality of charging and discharging cycles of the capacitor 102 to help reduce noise in the system, but this is not required, but this is not required. The DischargeFCTime should be the same whether the capacitor 102 was charged using R1 or R2 absent current leakage. Said another way, the ratio D1/D2 should be the same as the ratio R1/R2 absent current leakage. As such, a current leakage condition may be indicated when the ratio D1/D2 deviates from the ratio R1/R2 by more than a threshold amount.

In some cases, the microcontroller 110 may be configured to periodically change the negative supply voltage (Vee) provided by the negative voltage supply generator 118 of FIG. 1 from a nominal negative supply voltage (e.g. −800 mv) to a boosted negative supply voltage (−2200 mv) and then back again, as shown at 36. If there is no leakage in the flame sensing circuit, the detected flame current $I_{flame}$ should remain the same regardless of whether the negative supply voltage is set to the nominal negative supply voltage (e.g. −800 mv) or the boosted negative supply voltage (−2200 mv). The microcontroller 110 may determine a leakage current condition when the amplified flame sense current $I_{flame}$ detected by the detection circuit changes by more than a threshold amount when the negative supply voltage (Vee) is changed from the nominal negative supply voltage to the boosted negative supply voltage. For example, a 100 kOhm leakage path may appear as an 8 uA flame current during a nominal $V_{ee}$ cycle but as 22 uA during the boosted $V_{ee}$ cycle, which can be detected.

In some cases, the microcontroller 110 may be configured to change the negative supply voltage from the nominal negative supply voltage to the boosted negative supply voltage for a period of time (e.g. 200 milliseconds, 300 milliseconds, 500 milliseconds, 1 second, 5 seconds or any other suitable time) before changing the negative supply voltage back from the boosted negative supply voltage to the nominal negative supply voltage. The microcontroller 110 may wait for a period of time (e.g. 1 second, 2 seconds, 5 seconds, 10 seconds, 60 seconds, or any other suitable time) before again changing the negative supply voltage from the nominal negative supply voltage to the boosted negative supply voltage before changing the negative supply voltage back from the boosted negative supply voltage to the nominal negative supply voltage.

Figure 4:
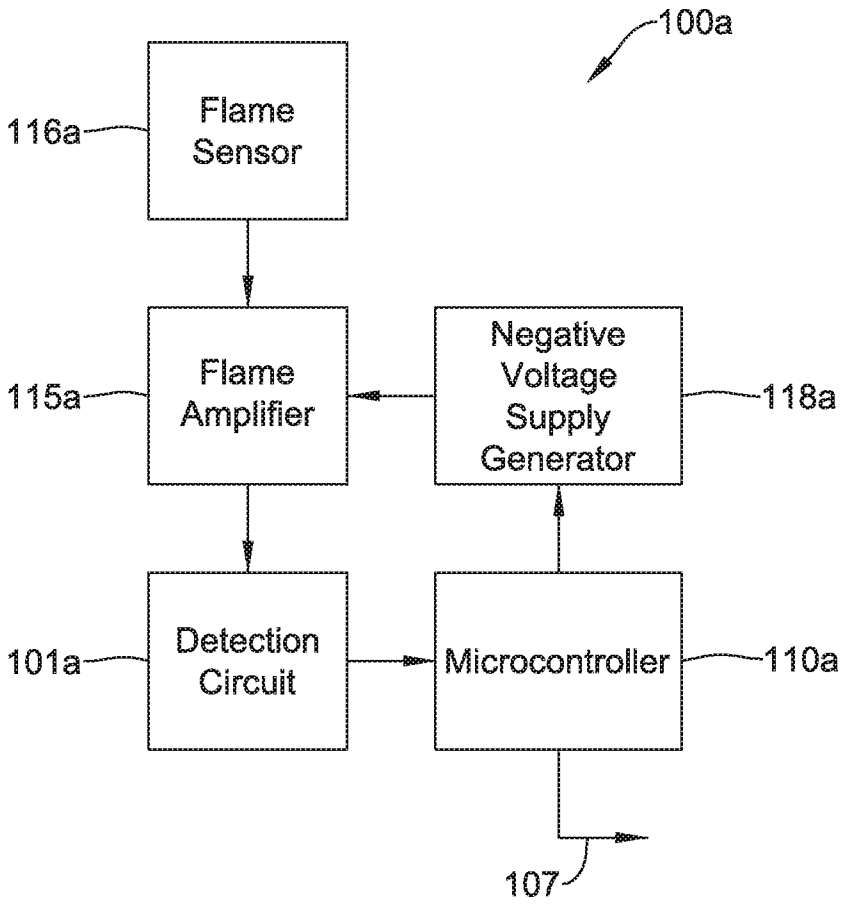
FIG. 4 is a schematic block diagram of an illustrative flame sense circuit.

FIG. 4 is a schematic block diagram of an illustrative flame sense circuit. The illustrative flame detection circuit 100*a* includes a flame sensor 116*a* for sensing a flame, a flame amplifier 115*a* operatively connected to the flame sensor 116*a*, a negative voltage supply generator 118*a*, a flame sense detection circuit 101*a* operatively coupled to the flame amplifier 115*a* output, and a microcontroller 110*a*.

The flame sensor 116*a* may draw a flame sense current when exposed to a flame. The flame amplifier 115*a* may amplify the flame sense current and draw an amplified flame sense current from an amplifier output. The negative voltage supply generator 118*a* may supply a negative supply voltage to the flame amplifier 115*a* as shown. The flame sense detection circuit 101*a* may detect the amplified sense current.

The microcontroller 110*a* may be operatively coupled to the negative voltage supply generator 118*a* and the flame sense detection circuit 101*a*. The microcontroller 110*a* may further be configured to change the negative supply voltage provided by the negative voltage supply generator 118*a* from a nominal negative supply voltage to a boosted negative supply voltage, determine a leakage current condition in the flame detection system when the amplified flame sense current detected by the flame detection circuit 101*a* changes by more than a threshold amount when the negative supply voltage is changed from the nominal negative supply voltage to the boosted negative supply voltage. The microcontroller 110*a* may further provide a shutdown signal 107 to shut down the flame (e.g. close a gas valve that supplies fuel to the combustion system) when a leakage current condition is determined.

The microcontroller 110*a* may be configured to change the negative supply voltage from the nominal negative supply voltage to the boosted negative supply voltage for a period of time (e.g. 200 milliseconds, 300 milliseconds, 500 milliseconds, 1 second, 5 seconds or any other suitable time) before changing the negative supply voltage back from the boosted negative supply voltage to the nominal negative supply voltage. The microcontroller 110*a* may wait for a period of time (e.g. 1 second, 2 seconds, 5 seconds, 10 seconds, 60 seconds, or any other suitable time) before again changing the negative supply voltage from the nominal negative supply voltage to the boosted negative supply voltage before changing the negative supply voltage back from the boosted negative supply voltage to the nominal negative supply voltage.

Figure 5:
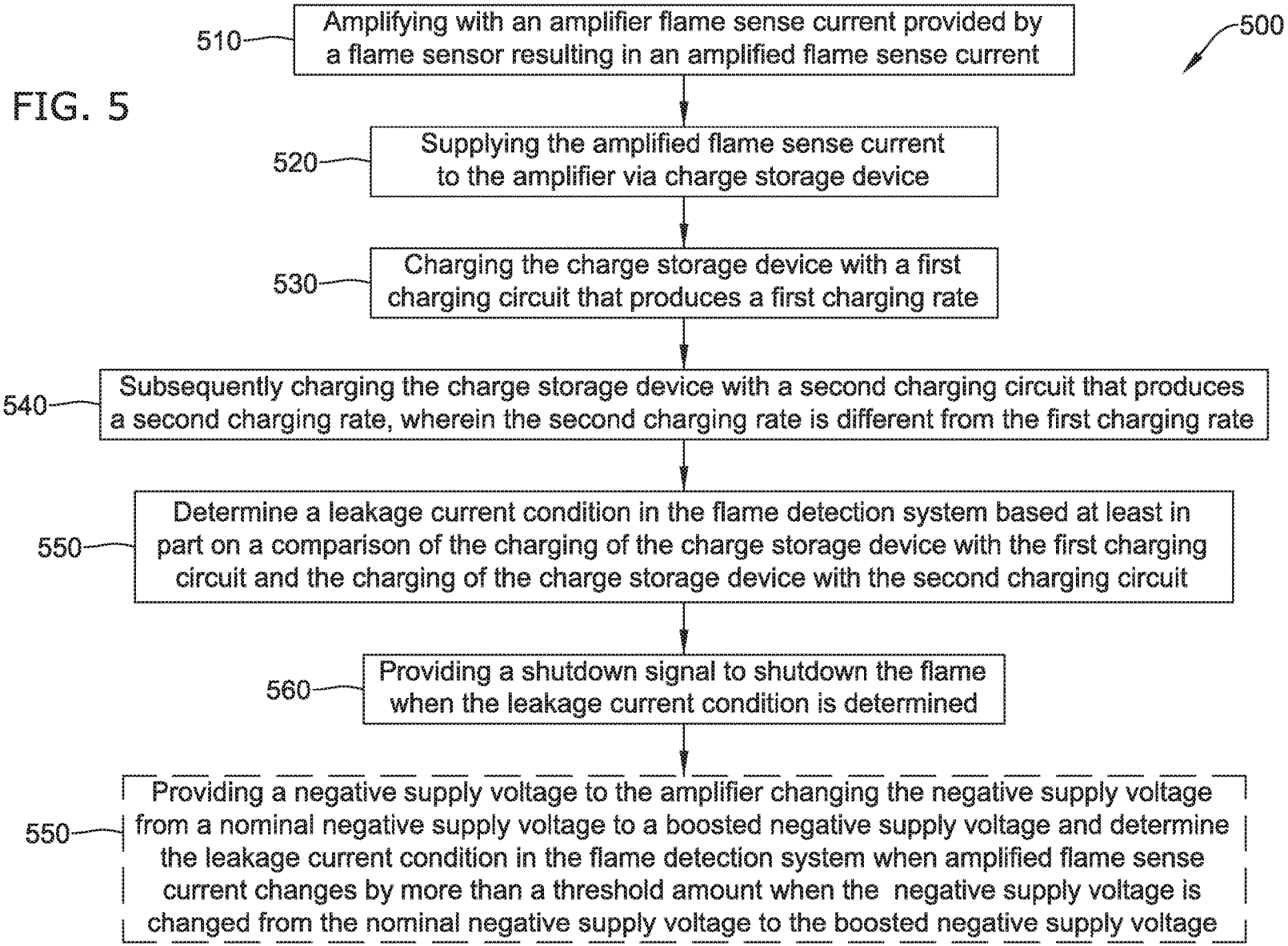
FIG. 5 is a flow diagram of an illustrative method for detecting a leakage current condition in a flame sensing circuit.

FIG. 5 is a flow diagram showing an illustrative method 500 for detecting a leakage current condition in a flame detection system. The method may include amplifying with an amplifier a flame sense current provided by a flame sensor, resulting in an amplified flame sense current as shown in block 510. The amplified flame sense current is supplied to the amplifier via charge storage device, as shown in block 520. A charge storage device is charged with a first charging circuit that produces a first charging rate, as shown in block 530, and then at least partially discharged via the amplified flame sense current. The charge storage device is subsequently charged by a second charging circuit that produces a second charging rate, and then at least partially discharged via the amplified flame sense current. The second charging rate is different from the first charging rate, as shown in block 540. A leakage current condition may be determined in the flame detection system based at least in part on a comparison of the charging of the charge storage device with the first charging circuit and the subsequent discharge via the amplified flame sense current, and the charging of the charge storage device with the second charging circuit and the subsequent discharge via the amplified flame sense current, as shown in block 550. A shutdown signal may be provided to shut down the flame (e.g. close a gas valve supplying fuel to the combustion system) when the leakage current condition is determined, as shown in block 560.

The method 500 may optionally include a negative supply voltage that is selectively changed from a nominal negative supply voltage to a boosted negative supply voltage, and a leakage current condition may be determining in the flame detection system when the sensed flame sense current changes by more than a threshold amount, as indicated at block 570.

Figure 6:
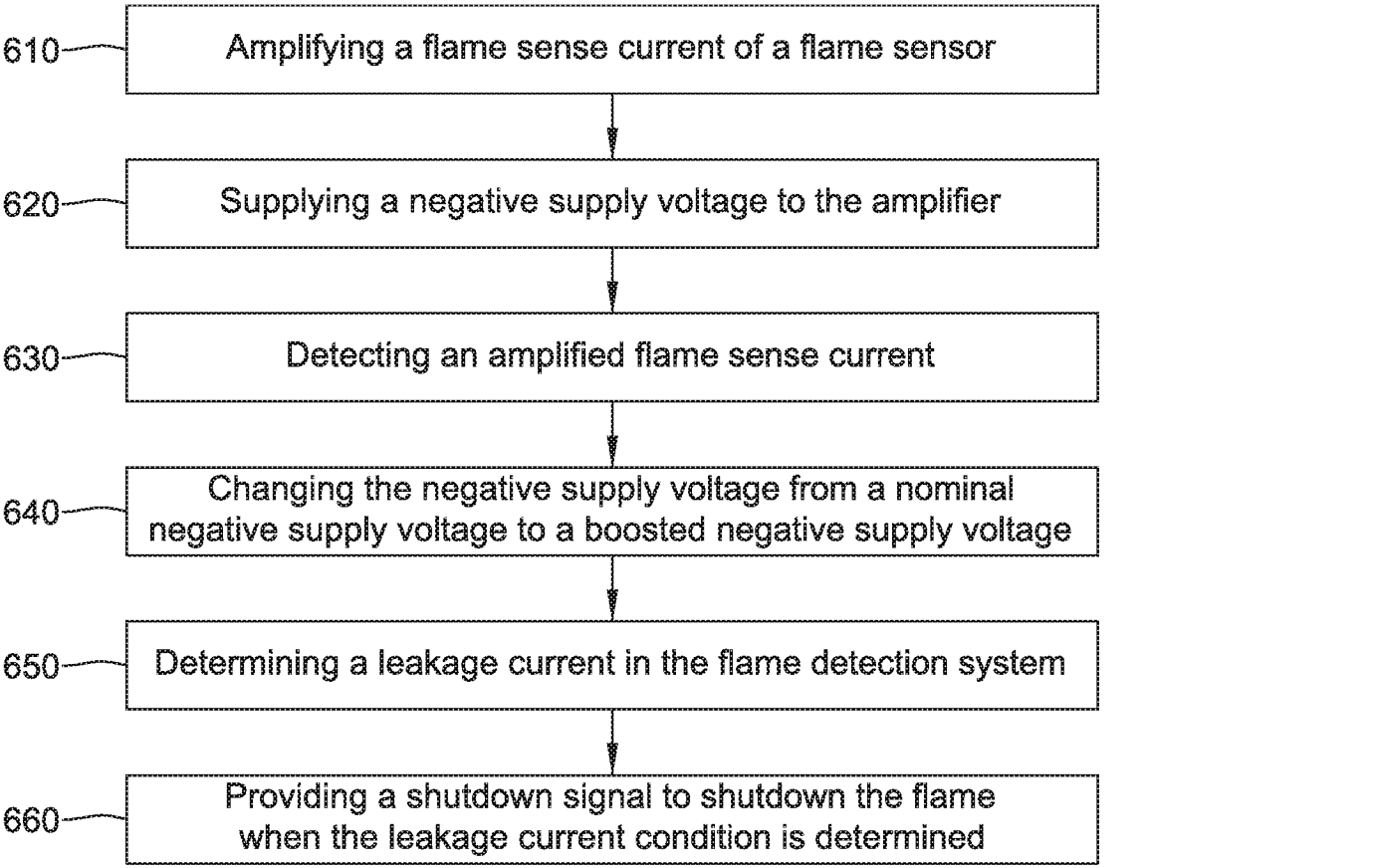
FIG. 6 is a flow diagram of another illustrative method for detecting a leakage current condition in a flame sensing circuit.

FIG. 6 is a flow diagram of another illustrative method 600 for detecting a leakage current condition in a flame sensing circuit. An amplifier may be operatively coupled to a flame sensor for amplifying a flame sense current of the flame sensor, as indicated at block 610. A negative voltage supply generator may be used for supplying a negative supply voltage to the amplifier, as indicated at block 620. The amplified flame sense current may be detected by a detection circuit, as indicated at block 630. A microcontroller may be configured to change the negative supply voltage from a nominal negative supply voltage to a boosted negative supply voltage, as indicated at block 640. A leakage current condition may be determined in the flame detection system when the amplified flame sense current detected by the detection circuit changes by more than a threshold amount when the negative supply voltage is changed from the nominal negative supply voltage to the boosted negative supply voltage, as indicated at block 650. A shutdown signal may be provided to shut down the flame (e.g. close a gas valve supplying fuel to the combustion system) when the leakage current condition is determined, as indicated at block 660.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A flame detection system comprising:

a flame sensor for sensing a flame, the flame sensor drawing a flame sense current when a flame is present;

an amplifier operatively coupled to the flame sensor for amplifying the flame sense current and drawing an amplified flame sense current from an amplifier output;

a detection circuit operatively coupled to the amplifier output for detecting the amplified flame sense current, the detection circuit comprising:

a capacitor having a first end operatively coupled to the amplifier output;

a first resistor having a first end operatively coupled to the amplifier output, the first resistor having a first resistance value;

a second resistor having a first end operatively coupled to the amplifier output, the second resistor having a second resistance value that is different from the first resistance value;

a microcontroller operatively coupled to a second end of the first resistor, a second end of the second resistor and the first end of the capacitor, wherein the microcontroller is configured to:

charge the capacitor through the first resistor from a first lower threshold voltage to a first upper threshold voltage, and then allow the amplified flame sense current to discharge the capacitor down to the first lower threshold voltage;

determine a first duty cycle of the charging of the capacitor through the first resistor and subsequent discharge of the capacitor;

charge the capacitor through the second resistor from a second lower threshold voltage to a second upper threshold voltage, and then allow the amplified flame sense current to discharge the capacitor down to the second lower threshold voltage;

determine a second duty cycle of the charging of the capacitor through the second resistor and subsequent discharge of the capacitor; and determine a leakage current condition in the flame detection system based at least in part on the first duty cycle, the second duty cycle, the first resistance value and the second resistance value; and providing a shutdown signal to shut down the flame when the leakage current condition is determined.

2. The flame detection system of claim 1, wherein first upper threshold voltage and the second upper threshold voltage are the same, and the first lower threshold voltage and the second lower threshold voltage are the same.

3. The flame detection system of claim 1, wherein the capacitor has a second end, and the second end is operatively coupled to ground.

4. The flame detection system of claim 3, wherein both the first upper threshold voltage and the second upper threshold voltage have a magnitude and are positive, and both the first lower threshold voltage and the second lower threshold voltage have the magnitude and are negative.

5. The flame detection system of claim 4, wherein the magnitude is substantially 50 mV.

6. The flame detection system of claim 1, wherein the microcontroller is configured to determine the first duty cycle of the charging of the capacitor through the first resistor and subsequent discharge of the capacitor by monitoring a voltage of the first end of the capacitor and clock how long it takes to charge the capacitor through the first resistor from the first lower threshold voltage to the first upper threshold voltage (ChargeR1Time), and to clock how long it takes for the amplified flame sense current to discharge the capacitor down to the first lower threshold voltage (DischargeFCTime), and calculate the first duty cycle using the relation ChargeR1Time/(ChargeR1Time+DischargeFCTime).

7. The flame detection system of claim 6, wherein the ChargeR1Time and DischargeFCTime are average values taken over a plurality of charging and discharging cycles of the capacitor.

8. The flame detection system of claim 1, wherein the microcontroller determines the leakage current condition in the flame detection system when the ratio of the first duty cycle to the second duty cycle is not within a predetermined margin of the ratio of the first resistance value to the second resistance value.

9. The flame detection system of claim 1, further comprising:

a negative voltage supply generator for supplying a negative supply voltage to the amplifier;

wherein the microcontroller is further configured to:

change the negative supply voltage from a nominal negative supply voltage to a boosted negative supply voltage;

determine the leakage current condition in the flame detection system when the amplified flame sense current detected by the detection circuit changes by more than a threshold amount when the negative supply voltage is changed from the nominal negative supply voltage to the boosted negative supply voltage.

10. The flame detection system of claim 9, wherein the microcontroller is further configured to change the negative supply voltage back from the boosted negative supply voltage to the nominal negative supply voltage.

11. The flame detection system of claim 10, wherein the microcontroller is configured to change the negative supply voltage from the nominal negative supply voltage to the boosted negative supply voltage for less than a second before changing the negative supply voltage back from the boosted negative supply voltage to the nominal negative supply voltage.

12. The flame detection system of claim 11, wherein after changing the negative supply voltage back from the boosted negative supply voltage to the nominal negative supply voltage, the microcontroller waiting for a predetermined period of time before again changing the negative supply voltage from the nominal negative supply voltage to the boosted negative supply voltage for less than a second before changing the negative supply voltage back from the boosted negative supply voltage to the nominal negative supply voltage.

13. The flame detection system of claim 12, wherein the predetermined period of time is greater than 1 seconds.

14. The flame detection system of claim 13, wherein the microcontroller is configured to change the negative supply voltage from the nominal negative supply voltage to the boosted negative supply voltage for less than 300 milliseconds before changing the negative supply voltage back from the boosted negative supply voltage to the nominal negative supply voltage, and the predetermined period of time is greater than 2 seconds.

15. A flame detection system comprising:

a flame sensor for sensing a flame, the flame sensor drawing a flame sense current when a flame is present;

an amplifier operatively coupled to the flame sensor for amplifying the flame sense current and drawing an amplified flame sense current from an amplifier output;

a negative voltage supply generator for supplying a negative supply voltage to the amplifier;

a detection circuit operatively coupled to the amplifier output for detecting the amplified flame sense current;

a microcontroller operatively coupled to the negative voltage supply generator and the detection circuit, wherein the microcontroller is configured to:

change the negative supply voltage from a nominal negative supply voltage to a boosted negative supply voltage;

determine a leakage current condition in the flame detection system when the amplified flame sense current detected by the detection circuit changes by more than a threshold amount when the negative supply voltage is changed from the nominal negative supply voltage to the boosted negative supply voltage;

providing a shutdown signal to shut down the flame when the leakage current condition is determined.

16. The flame detection system of claim 15, wherein the microcontroller is further configured to change the negative supply voltage back from the boosted negative supply voltage to the nominal negative supply voltage.

17. The flame detection system of claim 16, wherein the microcontroller is configured to change the negative supply voltage from the nominal negative supply voltage to the boosted negative supply voltage for less than a second before changing the negative supply voltage back from the boosted negative supply voltage to the nominal negative supply voltage.

18. The flame detection system of claim 17, wherein after changing the negative supply voltage back from the boosted negative supply voltage to the nominal negative supply voltage, the microcontroller waiting for a period of time before again changing the negative supply voltage from the nominal negative supply voltage to the boosted negative supply voltage for less than a second before changing the negative supply voltage back from the boosted negative supply voltage to the nominal negative supply voltage.

19. A method for detecting a leakage current condition in a flame detection system, the method comprising:

amplifying with an amplifier a flame sense current provided by a flame sensor, resulting in an amplified flame sense current;

supplying the amplified flame sense current to the amplifier via charge storage device;

charging the charge storage device with a first charging circuit that produces a first charging rate;

subsequently charging the charge storage device with a second charging circuit that produces a second charging rate, wherein the second charging rate is different from the first charging rate;

determine a leakage current condition in the flame detection system based at least in part on a comparison of the charging of the charge storage device with the first charging circuit and the charging of the charge storage device with the second charging circuit; and providing a shutdown signal to shut down the flame when the leakage current condition is determined.

20. The method of claim 19, further comprises:

providing a negative supply voltage to the amplifier;

changing the negative supply voltage from a nominal negative supply voltage to a boosted negative supply voltage; and determine the leakage current condition in the flame detection system when the amplified flame sense current changes by more than a threshold amount when the negative supply voltage is changed from the nominal negative supply voltage to the boosted negative supply voltage.

* * * * *